United States Patent [19]

Cattell et al.

[11] Patent Number: 4,552,782

[45] Date of Patent: Nov. 12, 1985

[54] ELECTROLUMINESCENT DEVICE

[75] Inventors: Alan F. Cattell; John Kirton, both of Malvern; Peter Lloyd, Great Malvern, all of England

[73] Assignee: The Secretary of State for Defence in Her Britannic Majesty's Government of the United Kingdom of Great Britain and Northern Ireland, London, England

[21] Appl. No.: 634,497

[22] Filed: Jul. 26, 1984

[30] Foreign Application Priority Data

Jul. 29, 1983 [GB] United Kingdom ..... 8320557

[51] Int. Cl.[4] ..... B05D 3/02; B05D 5/12

[52] U.S. Cl. ..... 427/66; 204/192 C; 427/64; 427/70

[58] Field of Search ..... 427/64, 66, 70; 204/192 C; 428/448, 690, 917

[56] References Cited

U.S. PATENT DOCUMENTS

| | | | |
|---|---|---|---|
| 3,108,904 | 10/1963 | Cusano | 428/917 X |
| 3,984,586 | 10/1976 | Kawarada et al. | 427/66 X |
| 4,242,370 | 12/1980 | Abdalla et al. | 427/66 |
| 4,496,610 | 1/1985 | Cattell et al. | 427/66 |

*Primary Examiner*—James R. Hoffman

*Attorney, Agent, or Firm*—Cushman, Darby & Cushman

[57] ABSTRACT

A method of electroluminescent panel manufacture in which a doped zinc chalcogenide phospher film—for example manganese doped zinc sulphide, is deposited upon an electrode bearing substrate in the presence of a hydrogen enriched atmosphere—for example a 90%:10% argon:hydrogen atmosphere. This is followed by rapid anneal treatment, the substrate being raised quickly to a temperature of 450° C., or greater, and cooled rapidly. It is preferable that, prior to film deposition, the substrate is pretreated by baking in the hydrogen enriched atmosphere. An additional current density limiting film may be applied—a film of low resistance cermet material—for example silica/nickel 20% Ni in $SiO_2$, or a film of amorphous silicon.

13 Claims, 1 Drawing Figure

ELECTROLUMINESCENT DEVICE

TECHNICAL FIELD

This invention concerns electroluminescent devices, especially thin film electroluminescent panels operable under conditions of AC or DC drive.

For some considerable time much interest has been shown in electroluminescent devices based on doped zinc chalcogenide phosphor material, in particular manganese-doped zinc sulphide material, for use in large-area complex displays. A number of different approaches to fabricating efficient devices of this type have been tried using either powder or thin film phosphors. See for example: Vecht et al, J Phys D, 2 (1969) 671 and Inoguchi et al, SID Int Symp Dig, 5 (1974) 84. For many applications, however, as in head-up cockpit displays, car dashboard displays and the like, the brightness, life or cost of such devices, has not yet proved wholly satisfactory.

BACKGROUND ART

Thin polycrystalline film manganese doped zinc chalcogenide phosphors have been prepared by radio-frequency (rf) sputtering. In the conventional application of this technique, the phosphor is deposited upon a heated substrate in an rf electric field using either a powder or a solid hot-pressed powder target of the phosphor material in a low pressure inert atmosphere—usually of argon gas. Radio-frequency (rf) sputtering has considerable commercial attractions as a method for depositing thin films. However, it has been established that for the production of efficiently luminescent ZnS:Mn thin films rf sputtering is satisfactory only if followed by a high temperature annealing process. For example (see Cattell et al, Thin Solid Films 92 (1982) 211–217) it has recently been shown that, under cathodoluminescent excitation, the saturation brightness of conventionally prepared rf sputtered thin film phosphors on silicon substrates may be enhanced by a post-deposition anneal treatment. As there reported, a number of different phosphor samples were treated by raising the sample substrate temperature to one of several different peak temperatures 400°, 500°, 600° and 700° C. respectively and maintaining each sample at peak temperature for a prolonged period of time, usually ½ hour, before allowing each sample to cool naturally. This was done in a resistively heated tube furnace in a continuously flowing argon atmosphere. The reported results show that with this post-deposition anneal treatment, the saturation brightness is increased progressively with increased peak temperature attained, at least up to a temperature of 700° C., appreciable increase in brightness being attained for temperatures in the range 600°–700° C.

Unfortunately, however, such post-deposition heat treatment is not readily applicable to electroluminescent panel manufacture. Such panels incorporate transparent electrode structures—eg electrodes of tin-oxide, indium tinoxide, or of cadmium stannate material. These electrode materials may become increasingly unstable when subjected to high treatment temperatures, ie, temperatures above 400° C., for prolonged periods; and indeed with some substrates the glass softening temperature may be such as to limit heat treatment to 450° C.

A solution to fabrication of a low cost high luminescent efficient ZnS:Mn film is not in itself sufficient for the fabrication of a successful low cost electroluminescent device. Such a device requires the non-destructive passage of high currents (~/A/cm$^2$, low duty cycle pulses for example) through the luminescent film and the background art consists of numerous partially successful schemes for providing this. In many, the solution has been to incorporate copper into the ZnS material but the inherent instability of $Cu_xS$ at temperatures above 60° C. has led to undesirable long term degradation effects. In others, copper has been avoided by automatically limiting the destructiveness of high currents by the use of capacitative coupling wherein the active ZnS:Mn film is supplied with current through encasing insulator layers. These insulators pass only displacement currents and these die away before the breakdown of the ZnS film becomes destructive. This capacitative coupling technique (commonly referred to as 'AC') requires the use of an inconveniently high alternating drive voltage which leads to high cost.

A better solution is to use direct coupling and to combat the inherent tendency of the ZnS to break down destructively. Hanak (Japan J Appl Phys Suppl 2, Pt 1 (1974) 809–812) has shown that the use of a high resistance current limiting rf sputtered high resistance cermet film intermediate the phosphor film and the backing electrode enhances stability at the price of considerable $I^2R$ losses in the limiting layer which leads again to examine drive voltage and loss of efficiency.

DISCLOSURE OF THE INVENTION

The invention disclosed hereinbelow is intended as an improvement in phosphor film deposition technique applicable to the manufacture of thin film electroluminescent panels wherein provision is made for the deposition of efficient phosphor films without recourse to excessive annealing temperatures. Furthermore, structures produced according to the method have an inherent tolerance to high current pulses which allows the use of lower current limiting materials and consequent reduction in drive voltage and increase in efficiency.

According to the invention there is provided a method of electroluminescent panel manufacture in which a doped zinc chalcogenide phosphor film is deposited upon the surface of a suitable prepared transparent electrode bearing substrate, wherein this deposition is performed in an hydrogen enriched atmosphere, and, following film deposition, the substrate is raised quickly to an elevated temperature of 450° C. or above in a suitable atmosphere, and, once such temperature is attained, cooled immediately at a relatively rapid rate, a rate being neither so slow as to result in a degradation of the attainable brightness, nor so fast as to result in thermal shock damage to the panel structure.

It has here been found that a panel, produced by the above method, exhibits an increase in the brightness that is attainable under operating conditions. Evidence of this improvement is set forth in the description that follows below.

The deposition may be performed, for example, by rf sputtering using, as target, doped zinc chalcogenide material in powder or hot pressed powder form. Alternatively, targets of zinc chalcogenide and of chalcogenides of manganese and/or rare earth elements may be used simultaneously.

The optimal rate for cooling, as aforesaid, is dependent upon the species of phosphor material as also upon the size and material of the supporting substrate. For the manufacture of a manganese-doped zinc sulphide thin film panel, a panel incorporating a supporting substrate of quartz or borosilicate glass material, a cooling rate in excess of 5° C. per minute, and usually in the range 10° to 20° C. per minute, would normally prove acceptable.

It is observed that prolonged post-deposition heat treatment, such as is typical of conventional anneal treatment would result in a degradation of the improved saturation brightness attained using the inventive method. The heat treatment, as used in the above inventive method, however, is effected so rapidly that such degradation is avoided, whilst at the same time it allows sufficient consolidation of the film to effect improvement in panel brightness and stability.

For a practical device operating with high dc pulses, an additional current density limiting film is required. This film may be of low resistance cermet material, for example rf sputtered silica/nickel or alternatively it may be of dc or rf sputtered amorphous silica.

DESCRIPTION OF EMBODIMENTS

Figure 1:
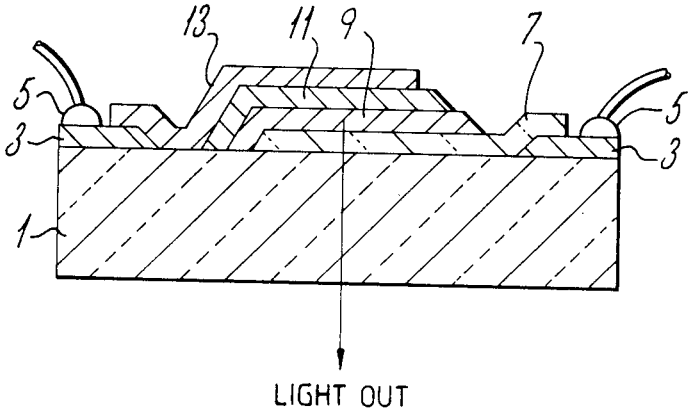

For the purposes of illustrating the performance of this inventive method, reference will be made now to an electroluminescent panel of which a simplified section is shown in FIG. 1, the accompanying drawing.

This panel comprises a transparent substrate 1 bearing a pair of connection lands 3 each having a low resistance contact 5. The substrate 1 supports a transparent electrode structure 7 which is overlaid by a thin film 9 of phosphor material. The electrode structure 7 lies in contact with one of the two connection lands 3 and the overlying phosphor film 9 is backed by an overlaid thin film 11 of resistive material and a further electrode structure 13. This latter electrode structure 13 extends to, and makes contact with, the other one of the connection lands 3.

This panel is manufactured by carrying out the stages detailed below:

(a) A clean substrate 1 of transparent material, for example quartz or borosilicate glas, is provided with a spaced pair of metallic connection lands 3. These lands 3 each have low resistance contacts 5 which are formed by soldering or bonding. A suitable land can be formed by first depositing a chrome seeding layer 150 Å thick followed by a gold layer 0.5 to 1μ thick. Here the gold deposition is phased in before the chrome deposition is terminated, so that a well bonded structure is formed.

(b) An optically transmitting electrode 7 of high electrical conductivity material is then deposited upon the substate 1 so as to partially overlap and make contact with one of the connecting lands 3. Although this electrode 7 can be of any material possessing suitable electrical and optical characteristics, one such material which as been found to possess the properties required is cadmium stannate when deposited and optimised by the methods described in United Kingdom Patent Specification GB 1,519,733—Improvements in or Relating to Electrically Conductive Glass coatings. A layer thickness of 3500 Å of cadmium stannate is suitable.

(c) The substrate 1 is then placed in a sputtering chamber pumped by a liquid nitrogen trapped diffusion pump capable of achieving a base pressure in the region of $3\times10^{-7}$ Torr. It is then baked for 30 mins at 400° C. using quartz-iodine lamp heaters. Whilst this stage of the process may be conducted under vacuum, it is found preferable to introduce an hydrogen enriched atmosphere, prior to baking. This, it is found, enhances the reproduceability of this process, and thus affords further improvement in yield. It is convenient, therefore, to introduce the sputtering atmosphere, as described below, at this earlier stage of the process. An electroluminescent film 9 is then deposited by radio frequency sputtering so as to overlay the electrode film 7, whilst the substrate 1 is maintained at a temperature of 200° C. The sputtering target from which thin film 9 is deposited is one of high purity zinc sulphide doped with 0.6 Mol % Manganese, hot pressed to a density of around 3.3 grams per cc and bonded to a metal upon a water-cooled target. The sputtering atmosphere used is a 90%/10% Argon/Hydrogen mixture at a pressure of 4.4 to $4.6\times10^{-3}$ Torr. The thickness of this film 9 is chosen to suit working voltage requirements. A typical value for this thickness is 1μ, and is formed at a deposition rate in the range 80–100 A/min. Although the phosphor ZnS(Mn) is embodied in the device described, neither the device geometry nor the processing steps preclude the use of other suitable zinc chalcogenide phosphors or of rare-earth dopants.

Stoichiometry of the growing phosphor film and its dopant level is determined by recombination effects at the substrate and is critically related to substrate temperature. The film composition can also be affected by target surface temperature and steps should be taken to control this parameter, at a given power level, by ensuring that the back of the target is kept at the cooling water temperature. For constant and improved thermal conductivity over the whole of the interfacial area between target and water-cooled target electrode it may be necessary to use a two component resin bonding agent, correctly formulated for vacuum use, between the target and electrode faceplate. A figure for ZnS target density has been given already. However, it should be stressed that a figure of greater than 90% of theoretical density is always to be preferred in order to reduce the effects, reactive or otherwise, of a large target gas content.

(d) Following deposition of the phosphor layer 9, its stability and luminescent properties are further optimized by a post-deposition heat treatment. This heat treatment is carried out in a tubular furnace of low thermal capacity so as to achieve relatively rapid heating and a relatively rapid cooling rate in the range 10° to 20° C. per minute. Cooling is assisted by increasing the argon flow over the substrate 1. The procedure is essentially that of raising the substrate to a selected temperature followed by immediate rapid cooling. The selected temperature is determined by factors relating to substrate material and prior processing, however a typical value is 450° C. Alternatively, the heat treatment may be carried out in other inert or non-reactive atmospheres or invacuo immediately following deposition of the phosphor film 9 so as to reduce production time.

(e) After heat treatment, the substrate 1 is coated in selected areas with a cermet film layer 11. In the device described, the cermet layer 11 is of silica/nickel material and is deposited from a composite sputtering target of silica and nickel, in which the surface area of the target comprises 20% nickel. The thickness of the cermet layer 11 is chosen according to the performance characteristics desired. A typical thickness is 8000 Å, deposited at a rate of 120–180 A per minute. An added advantage of this choice of cermet material is that it is black in colour, so providing a high optical contrast to the light emitting areas of the phosphor layer 9. The form of the device does not however preclude the use of cermets of other compositions or proportions, as long as the voltage dropped at ~1A/cm² does not exceed ~10 mV.

(f) To complete the device a metal film 13, which can conveniently be of aluminium in the thickness range 2000–6000 Å, is vacuum deposited so as to overlap the cermet film and to make contact with the remaining connection land 3.

In the foregoing process, a film of amorphous silicon may be deposited in place of the cermet film 11. This likewise may be deposited by dc or rf sputtering.

Manganese doped zinc sulphide phosphor films deposited by rf sputtering in an hydrogen enriched argon atmosphere have been tested using pulsed cathodoluminescence exictation. The results found are tabulated below and are compared with results found for annealed films deposited by rf sputtering in a conventional argon atmosphere. In all cases the films were deposited upon a single-crystal silicon substrate.

TABLE

| RF Atmosphere | Anneal Temperature (°C.) | Saturation Brightness (Relative units) |
|---|---|---|
| Argon/Hydrogen | — | 1 |
| Argon | 700 | 1 |
| " | 600 | 0.53 |
| " | 500 | 0.37 |
| " | 400 | 0.22 |
| " | — | 0.1 |

As can be seen from an inspection of these results, the saturation brightness found for the film is a factor x10 up on that for conventional sputtered film as deposited, and is comparable to that found upon annealing to 700° C.

It is noted that film samples, obtained by rf sputtering in an hydrogen enriched atmosphere as above, show a severe decrease in attainable brightness if annealed for extended periods at temperatures in excess of 200° C. Provided, however, any heat treatment is of the relatively rapid form described above, this severe decrease may be avoided.

An illustration of the improvements in efficiency, brightness and life, attained for panels produced by this inventive method, is given below:

Sample 378: ZnS:Mn 1μ thick upon a cadmium stannate electrode bearing substrate, heated to a maximum temperature of 550° C. and rapidly cooled. Selected areas coated with a cermet film (nominal 20% Ni in $SiO_2$) 0.8μ thick; A1 top electrodes.

Continuous DC operation (cermet free areas): 80 ft L at 96 V, 8 mA/cm². 0.02% efficiency (Wat/Watt).

Pulsed operation (simulated 100 row matrix, cermet included): 27 ft L at 98 V, 400 mA/cm², 1% duty cycle 10 μs pulses.

Lifetest (under above pulsed conditions, cermet included) 27 ft L to 13 ft L in 1000 hours.

What I claim is:

1. A method of electroluminescent panel manufacture in which a doped zinc chalcogenide phosphor film is deposited upon the surface of a transparent electrode bearing substrate, wherein this deposition is performed in an hydrogen enriched atmosphere, and following the deposition of the film, the film bearing substrate is heated rapidly to an elevated temperature of at least 450° C. in a non-reactive environment, and, immediately upon such temperature being reached, is cooled at a rate intermediate to those which would cause thermal shock and brightness degradation respectively.

2. A method, as claimed in claim 1, wherein, prior to film deposition the substrate is prepared by baking in an hydrogen enriched atmosphere.

3. A method, as claimed in claim 1, and wherein the deposition is performed in an hydrogen enriched argon atmosphere.

4. A method, as claimed in claim 3, wherein the proportions of argon and hydrogen are approximately 90% and 10% respectively.

5. A method, as claimed in claim 1, wherein the zinc chalcogenide is zinc sulphide.

6. A method, as claimed in claim 1, wherein the deposition is performed by rf sputtering using as target doped zinc chalcogenide material.

7. A method, as claimed in claim 1, wherein the deposition is performed by rf sputtering using as target materials zinc chalcogenide and a chalcogenide of manganese or a rare earth element, as dopant source.

8. A method, as claimed in claim 1, wherein the transparent electrode is of cadmium stannate material.

9. A method as claimed in claim 1, wherein the transparent electrode is of tin oxide.

10. A method, as claimed in claim 1, wherein the transparent electrode is of indium tin oxide.

11. A method, as claimed in claim 1, wherein the film bearing substrate is cooled at a rate in excess of 5° C. per minute.

12. A method, as claimed in claim 11 wherein the film bearing substrate is cooled at a rate of between 10° C. and 20° C. per minute.

13. A method, as claimed in claim 1 wherein the elevated temperature is in the range 450°–550° C.

* * * * *